US006695504B2

(12) United States Patent
Matsumoto

(10) Patent No.: US 6,695,504 B2
(45) Date of Patent: Feb. 24, 2004

(54) CONVEYING APPARATUS AND RECORDING APPARATUS

(75) Inventor: Tadashi Matsumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 09/900,948

(22) Filed: Jul. 10, 2001

(65) Prior Publication Data

US 2002/0021312 A1 Feb. 21, 2002

(30) Foreign Application Priority Data

Jul. 11, 2000 (JP) ..... 2000-209257
Aug. 30, 2000 (JP) ..... 2000-260355

(51) Int. Cl.[7] ..... B41J 13/02; B41J 2/01

(52) U.S. Cl. ..... 400/635; 400/634; 347/104; 271/193

(58) Field of Search ..... 400/635, 634; 271/193; 198/691; 347/104, 101

(56) References Cited

U.S. PATENT DOCUMENTS 3,690,646 A * 9/1972 Kolibas ..... 271/193
5,121,170 A * 6/1992 Bannai et al. ..... 271/193
5,593,151 A * 1/1997 Mashtare et al. ..... 271/193
6,394,596 B1 * 5/2002 Wotton et al. ..... 347/104
6,419,411 B1 * 7/2002 Tanno ..... 400/635

FOREIGN PATENT DOCUMENTS

EP 0917961 A2 * 11/1998 ..... B41J/13/10
EP 0 917 961 5/1999

* cited by examiner

*Primary Examiner*—Stephen D. Meier
*Assistant Examiner*—Manish Shah
(74) *Attorney, Agent, or Firm*—Fitzpatrick, Cella, Harper & Scinto

(57) ABSTRACT

A conveying apparatus for attracting and conveying a conveyed object by a belt provided with electrodes, includes an applying unit for applying a voltage to the electrodes to generate an electric force and a belt attracting unit for attracting the belt utilizing the electric force. Vibration of the conveying belt during conveyance can be suppressed and stable conveyance of a conveyed object can be realized.

19 Claims, 12 Drawing Sheets

CONVEYING APPARATUS AND RECORDING APPARATUS

BACKGROUND OF THE INVENTION

1. Field of the Invention

The present invention relates to a conveying apparatus using a conveying belt and a recording apparatus for recording an image on a conveyed object conveyed by the conveying apparatus, which can be preferably utilized in particular for a conveying apparatus for applying a voltage to electrodes provided on the conveying belt to convey the conveyed object while electrostatically adsorbed or attracted to the conveying belt and a recording apparatus provided with the conveying apparatus.

2. Related Background Art

Conventionally, as a recording apparatus of this type, there is known, for example, a recording apparatus such as a printer by an ink-jet method.

In general, an ink-jet recording apparatus is an apparatus for discharging ink from a recording head to record an image on a recording medium. The ink-jet recording apparatus has such advantages that a recording head can be made compact easily, an image of high definition can be recorded fast, running costs are low, noise is less due to a non-impact method and it is easy to record a color image using inks of many colors.

Among all recording apparatuses of this type, an apparatus of a full-line type can realize further high-speed recording, which uses a recording head of a line-type in which a multiplicity of nozzles are arranged in a paper width direction.

However, in the apparatus of a full-line type, a distance from a recording head in a position on the most upstream side to a recording head in a position on the most downstream side becomes rather long. Thus, rising of a recording sheet occurs in a recording area and a jam or a disturbance of a recording image is caused.

Therefore, there is generally known a method of generating an electric force by applying a voltage to electrodes provided on a conveying belt to adsorb or attract the recording sheet so as to urge the recording sheet downward to prevent it from rising.

In such an ink-jet recording apparatus, a recording sheet supplied by a sheet supplying device is conveyed while being adsorbed to an upper surface of a conveying belt and held there by adsorption force generating means provided on the conveying belt, and an image is recorded on a recording area by a recording head.

FIG. 9 is a schematic view showing the configuration of an entire recording apparatus in accordance with a conventional art. The recording apparatus having an automatic sheet supplying device is composed of (I) a sheet supplying unit, (II) a conveying belt unit, (III) a recording head unit and (IV) a sheet discharging unit. Each of these units will be hereinafter described with reference to FIG. 9. (I) Sheet supplying unit In the figure, a sheet supplying unit 102 has a configuration in which a pressure plate 121 loading a recording sheet P and a supplying rotator 122 supplying the recording sheet P are attached to a base 120. The pressure plate 121 is rotatable around a rotation shaft a combined to the base 120 and is biased to the supplying rotator 122 by a pressure plate spring 124.

In a part of the pressure plate 121 opposing the supplying rotator 122, a separation pad 125 is provided which is made of a material with a large friction coefficient such as artificial leather for preventing double supplying of the recording sheet P.

Moreover, in the base 120, a separation pawl 126 for covering a corner part of loaded recording sheet P in one direction to separate one recording sheet P from another and a not-shown release cam for releasing abutment of the pressure plate 121 and the supplying rotator 122 are provided.

In the above-mentioned configuration, in a waiting state, the release cam presses down the pressure plate 121 to a predetermined position, and then the abutment of the pressure plate 121 and the supplying rotator 122 is released.

In this state, when a driving force of a conveying roller 132 is transmitted to the supplying rotator 122 and the release cam by a gear or the like, the release cam separates from the pressure plate 121 to lift the pressure plate 121, and the supplying rotator 122 and the recording sheet P abut each other.

Then, as the supplying rotator 122 rotates, the recording sheet P is picked up and starts to be supplied, and one sheet is separated from another by the separation pawl 126 to be sent to a conveying belt unit 103.

The supplying rotator 122 continues to rotate until it supplies the recording sheet P into the conveying belt unit 103. Then, the sheet supplying unit turns into a waiting state again in which the abutment of the recording sheet P and the supplying rotator 122 is released, and the driving force from the conveying roller 132 is cut off.

Reference numeral 190 denotes a supplying rotator for hand supplying. The supplying rotator 190 supplies the recording sheet P placed on a hand supply tray 191 in accordance with a record instruction signal of a computer and conveys it to the conveying belt unit 103.

(II) Conveying Belt Unit

The conveying belt unit 103 has a conveying belt 131 for adsorbing and conveying the recording sheet P and a not-shown PE sensor. The conveying belt 131 is driven by a driving roller 134 and is wound and suspended by a conveying roller 132 and a pressure roller 135 that are driven rollers.

Further, the conveying roller 132 and the driving roller 134 are rotatably attached to a platen 130, the pressure roller 135 is rotatably attached to the other end of an arm 150 that is swingably attached to the platen 130 at one end, and applies a tension to the conveying belt 131 by the arm 150 being pressed by a spring 151.

In addition, the platen 130 is positioned below the conveying belt 131 and plays a role of regulating downward displacement of the conveying belt 131.

In a position opposing the conveying roller 132, a pinch roller 133 following the conveying belt 131 is provided abutting the conveying belt 131. The pinch roller 133 becomes in contact with the conveying belt 131 under pressure by a not-shown spring, thereby guiding the recording sheet P to a recording head unit 107.

At an entrance of the conveying belt unit 103 to which the recording sheet P is conveyed, an upper guide 127 and a lower guide 128 for guiding the recording sheet P are arranged. In addition, a PE sensor lever 123 for transmitting detection of a front end and a rear end of the recording sheet P to a PE sensor (not shown) is provided in the upper guide 127.

Moreover, the recording head unit 107 for forming an image based on image information is provided on the downstream side in the conveying direction of a recording sheet of the conveying roller 132.

In the above-mentioned configuration, the recording sheet P conveyed to the conveying belt unit 103 is guided by the upper guide 127 and the lower guide 128 and then conveyed to a roller pair of the conveying roller 132 and the pinch roller 133. At this point, a recording position on the recording sheet P is found by sensing the front end of the conveyed recording sheet P by the PE sensor lever 123.

In addition, the recording sheet P is conveyed by the conveying belt 131 rotating via the conveying roller 132 by a sheet feeding motor to be described later.

(III) Recording Head Unit

The recording head unit 107 is provided with four ink-jet recording heads of line type in which a plurality of nozzles are arranged in a direction perpendicular to the conveying direction of the recording sheet P. These ink-jet recording heads are arranged on a head holder 170 with a predetermined interval in the order of 107K (black), 107C (cyan), 107M (magenta) and 107Y (yellow) from the upstream in the conveying direction of the recording sheet P.

The recording heads 107K, 107C, 107M and 107Y can give heat to ink by a heater or the like. Then, the ink is film-boiled by this heat, and the ink is discharged from the nozzles of the recording heads 107K, 107C, 107M and 107Y by pressure change caused by growth or contraction of bubbles due to this film boiling to form an image on the recording sheet P.

Further, the head holder 170 is rotatably fixed by a shaft 172 at one end, and a protruded portion 171 provided on the other end and a rail 173 engage with each other, whereby a distance (sheet distance) between nozzle surfaces and the recording sheet P is defined.

(IV) Sheet Discharging Unit

A sheet discharging unit 104 is composed of a sheet discharging roller 141 and a spur 142. The recording sheet P on which an image is formed by the recording head unit 107 is nipped and conveyed by the sheet discharging roller 141 and the spur 142 to be discharged to a sheet discharge tray 143.

The rotation force of the driving roller is transmitted by a transmitting-means (not shown) to the discharging roller 141 to be driven.

Further, the external circumference of the spur 142 is formed as a sharpened uneven surface and prevents ink of a recorded image from being transferred by the spur 142 when the spur 142 rolls on a recording surface after an image is recorded.

The mechanism and operations of adsorbing conveyance of a conveying apparatus in accordance with the conventional art will now be described with reference to FIGS. 10 to 13.

FIG. 10 is a schematic view showing a configuration of a conveying apparatus in accordance with the conventional art.

In the figure, reference numeral 131 denotes a conveying belt that moves while adsorbing and holding the recording sheet P. The conveying belt 131 is made of a synthetic resin such as polyethylene and polycarbonate with a thickness of approximately 0.1 mm to 0.2 mm and is formed as an endless belt.

Reference numeral 152 denotes a power feeding brush connected to a high voltage power source (not shown) that generates a predetermined high voltage. The power feeding brush 152 is provided joining the conveying belt 131.

Adsorption force generating means 136 to be described later are provided in the conveying belt 131. When the power feeding brush 152 applies a voltage of approximately 0.5 KV to 10 KV to the adsorption force generating means 136, an adsorption force is generated in the conveying belt 131.

The conveying roller 132, the driving roller 134 and the pressure roller 135 are rollers that support the conveying belt 131 and impart an appropriate tension to the conveying belt 131. The driving roller 134 is combined with a sheet feeding motor 160.

In addition, a sheet pressing roller 140 as pressing means for pressing the recording sheet P on a conveying belt side is rotatably attached to a sheet pressing roller supporting member 139. The sheet pressing roller supporting member 139 is mounted so as to rotate around the rotation shaft of the pinch roller 133. The sheet pressing roller 140 is biased to the conveying belt 131 side by not-shown biasing means.

Reference numeral 138 indicates a cleaning roller pair, which is provided to nip the conveying belt 131 under pressure. The cleaning roller pair is capable of absorbing ink in order to remove stain such as ink stuck to the conveying belt 131 and is formed of a sponge of continuous vesicles with a small diameter (preferably 10 $\mu$m to 30 $\mu$m) in order to prevent deterioration in endurance.

Reference numeral 137 denotes a charge removing brush serving as a charge removing means of the conveying belt 131.

In the above-mentioned configuration, the recording sheet P conveyed from a sheet feeding unit is nipped by the conveying roller 132 and the pinch roller 133 on the conveying belt 131 and is pressed to the conveying belt 131 side by the sheet pressing roller 140.

Then, the recording sheet P is adsorbed on a flat part of the conveying belt 131 by an electric force generated by the adsorption force generating means 136 to which a voltage is applied from the power feeding brush 152.

The recording sheet P adsorbed to the conveying belt 131 is guided to the recording head unit 107 and conveyed in an arrow A direction by the sheet feeding motor 160 and the driving roller 134 while recording an image thereon by the recording heads 107K, 107C, 107M and 107Y.

Charge is removed from the conveying belt 131 by the charge removing brush 137 after it is cleaned by the cleaning roller 138.

The adsorption force generating means 136 will now be described with reference to FIGS. 11 to 13.

FIG. 11 is a schematic view showing the configuration of a conveying belt viewed from an arrow f direction of FIG. 10 and shows an electrode pattern or the like of the adsorption force generating means provided on the conveying belt. FIG. 12 is a sectional view of the conveying belt viewed from an arrow a direction of FIG. 11. FIG. 13 is a sectional view of the conveying belt viewed from an arrow b direction of FIG. 11.

In the figure, the adsorption force generating means 136 are provided inside the conveying belt 131. The adsorption force generating means 136 are composed of electrode plates 136*a* and ground plates 136*b* that are made of conductive metal. The adsorption force generating means 136 are formed in a ctenidium (or ctenoid) shape with each tooth provided independently as shown in the figure. A plurality of adsorption force generating means 136 are provided on the conveying belt 131 in such a manner that the respective adsorption force generating means 136 face each other in the direction perpendicular to the belt conveying direction.

On both sides in the moving direction of the conveying belt 131, power fed portions 136*a*' and 136*b*', which expose patterns, respectively, are provided so as to be of a distance longer than the width of respective electrodes 136*a* and 136*b* in the belt moving direction. A conductive power feeding brush 152 is provided which contacts each of them with a predetermined pressure.

A positive or negative voltage is applied to the power fed portions 136*a*' of the electrode plates 136*a* from a not-shown high pressure power source by this power feeding brush 152. In addition, the power fed portion 136*b*' of the ground plates 136*b* are connected to the earth.

As shown in FIGS. 12 and 13, the conveying belt 131 is provided with the adsorption force generating means 136, which are composed of the electrode plates 136*a* an the ground plates 136*b* that are made of conductive metal in adsorption force generating areas, while being protected by being sandwiched by a base layer 136*c* and a surface layer 136*d*. The base layer 136*c* and the surface layer 136*d* are formed of synthetic resin such as polyethylene and polycarbonate.

When a voltage is given to the electrode plates 136*a*, an electric force is generated in an arrow direction and an electric line of force shown in the figure is formed. Then, an adsorption force is generated in an upward position on the conveying belt 131 by a potential difference between the electrode plates 136*a* and the ground plates 136*b*, which adsorb the recording sheets P. On a recording surface of adsorbed recording sheet P, a charge (surface potential) of the same polarity as the voltage given to the electrode plates 136*a* is generated.

Further, the adsorption force received by the recording sheet P is the weakest at parts where there is no conductive metal between the electrode plates 136*a* and the ground plates 136*b*.

If a large amount of ink is discharged on the recording sheet P, the recording sheet P swells and cockling occurs. Even in this case, the recording sheet P is adsorbed to the conveying belt 131 side by the adsorption force of the adsorption force generating means 136. Thus, rising of the recording sheet P to the recording head unit 107 side is eliminated, whereby stable recording can be performed without contact of the recording heads 107K, 107C, 107M and 107Y and the recording sheet P.

In addition, the cockling is forced to be scattered to occur in areas where adsorption force on the conveying belt 131 is the weakest (parts where there is no conductive metal between the electrode plates 136*a* and the ground plates 136*b*), whereby rising of the recording sheet P to the recording head unit 107 side can be minimized.

In addition, even if the ends of the recording sheet P cockle or curl due to change of environmental factors such as temperature or humidity, the recording sheet P can be pressed to the conveying belt 131 side by the sheet pressing roller 140 to be conveyed to an adsorption force generating area in a state where cockling and curling are removed. Thus, a stable adsorption force can be formed in the recording head unit 107.

FIG. 14 is a schematic perspective view showing a configuration of a platen in accordance with the conventional art.

In the platen 130, ribs 130*b*, which are disposed in parallel with a belt conveying direction at an arbitrary interval, are on a platen base 130*a*. An upper surface of each of the ribs 130*b* is positioned 0 to 0.5 mm below a plane connecting the upper surfaces of the driving roller 134 and the conveying roller 132, thereby regulating the conveying belt 131 so as not to be lower than the upper surfaces of the ribs 130*b* when the belt rotates.

In addition, the conveying belt 131 is adsorbed to the entire surface of the platen 130 by an electric force that is generated by applying a voltage to the conveying belt 131, so that rotation error or inaccurate conveyance due to increase of rotation loading is prevented.

However, in the case of the above-mentioned conventional art, problems described below occur.

In an ink-jet recording apparatus, it is required to perform conveyance with high accuracy while keeping an interval between a recording sheet and a recording head close and constant in order to obtain an image quality of high definition. In particular, it becomes a factor directly affecting an image quality, in a 1 pass high speed recording apparatus using a line head.

In a recording apparatus in accordance with the above-mentioned conventional art, a conveying belt immediately below a recording head is suspended by the conveying roller 132 and the driving roller 134. Thus, there is a problem that dispersion with a peculiar vibration occurs during high speed rotation that deteriorates an image quality.

In addition, the conveying belt 131 is composed of the adsorption force generating means 136 by ctenidium electrodes consisting of the electrode plates 136*a* and the ground plates 136*b*, the base layer 136*c* and the surface layer 136*d*, and the layers are joined by such means as adhesives or thermal deposition to each other.

If the conveying belt 131 is left for a long time in a state in which the conveying belt 131 is wound and suspended by the conveying roller 132, the driving roller 134 and the pressure roller 135, wrinkles are left in parts with large curvature abutting each of the rollers due to a difference of curving natures inherent to materials.

When a conveying operation is started, the conveying belt 131 suspended by the conveying roller 132 and the driving roller 134 is pulled in the conveying direction by a tension applied by the pressure roller 135.

However, as shown in FIG. 15, there is a problem in that a peculiar shape remains at a part where a wrinkle is left, and cockling of approximately 0.5 mm to 1.0 mm occurs to deteriorate an image quality in a position opposing the recording head unit 107.

A method of controlling a recording part of the recording sheet P not to be positioned at a remaining wrinkle shape part of the conveying belt 131 is possible. However, in an ink-jet recording apparatus, since an interval between the recording head unit 107 and the recording sheet P is as small as 1.0 mm to 1.5 mm, the recording sheet P rubs a nozzle surface depending on a wrinkle shape, which may cause phenomena such as breakage of a nozzle portion, mixed colors or adhesion due to reactions of inks to make recording impossible.

In addition, as shown in FIG. 16, a method of providing a spur in a position opposing each nozzle to stretch and suspend a conveying belt is also possible. However, this will cause a problem such as deterioration of an image quality or traces of the spur in a high speed recording operation or leakage of a high voltage due to deterioration of a conveying belt surface layer. Thus, this is not suitable for a high speed ink-jet recording apparatus of full-line type.

SUMMARY OF THE INVENTION

It is an object of the present invention to provide a conveying apparatus and a recording apparatus with high reliability that can suppress vibration of a conveying belt during conveyance and steadily convey a conveyed object.

It is another object of the present invention to provide a conveying apparatus for adsorbing and conveying a conveyed object by a belt provided with electrodes, wherein the conveying apparatus is provided with applying means for applying a voltage to the electrodes to generate an electric force and belt attracting means for attracting the belt utilizing the force.

Other objects, features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

<First Embodiment>

A preferred embodiment of the present invention will be hereinafter described illustratively in detail with reference to the drawings. However, dimensions, materials, shapes and relative arrangements of components described in this embodiment are not meant to limit the scope of the present invention to them unless otherwise specified.

A conveying apparatus in accordance with the embodiment of the present invention will be described with reference to FIGS. 1 to 5B.

Figure 1:
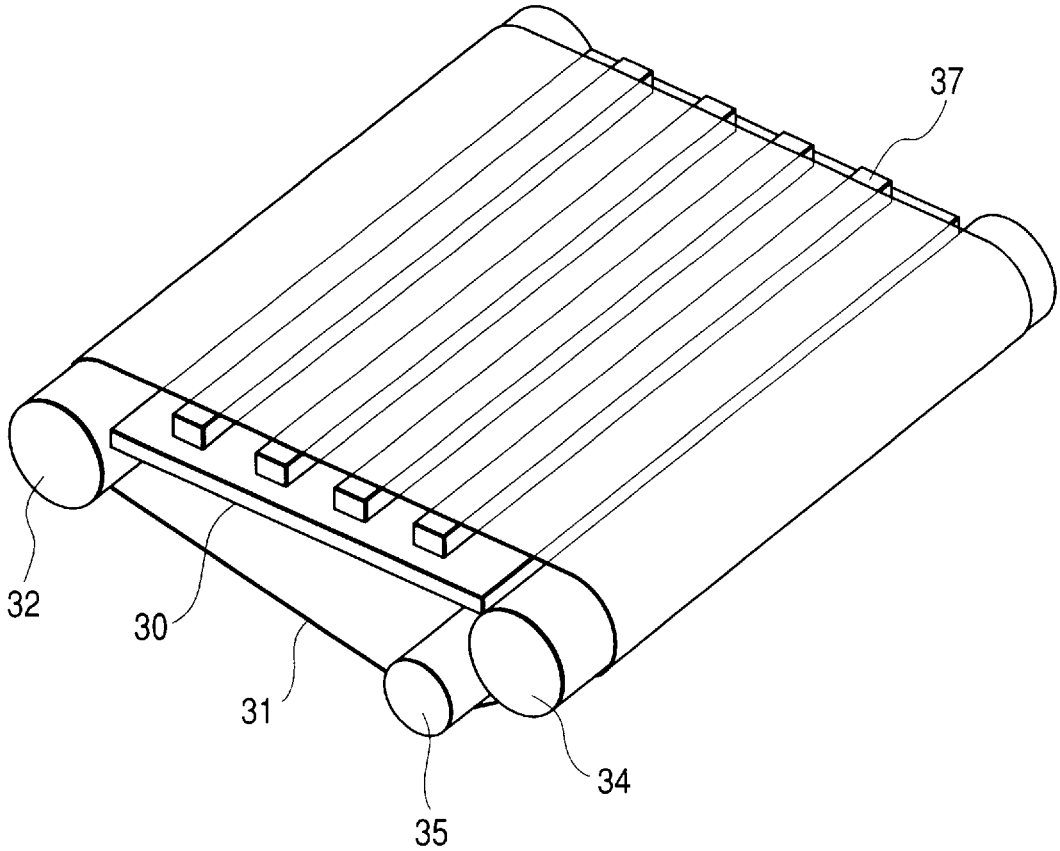
FIG. 1 is a schematic perspective view showing a configuration of a main part of a conveying apparatus in accordance with an embodiment of the present invention.
Figure 2:
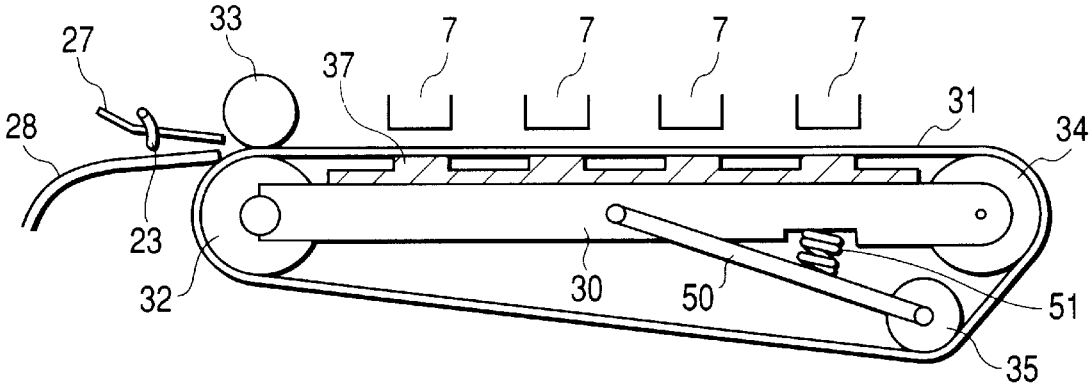
FIG. 2 is a schematic view showing the configuration of a main part of the conveying apparatus in accordance with the embodiment of the present invention.
Figure 3:
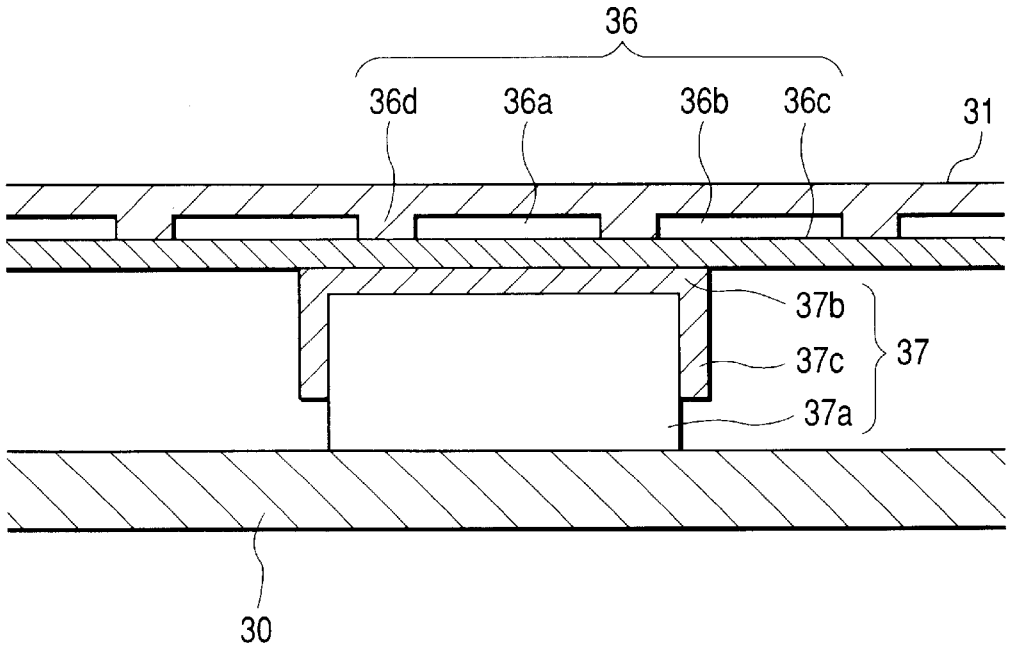
FIG. 3 is a schematic sectional view of belt attracting means in accordance with the embodiment of the present invention.

FIG. 1 is a schematic perspective view showing the configuration of a main part of the conveying apparatus in accordance with the embodiment of the present invention. FIG. 2 is a schematic view showing the configuration of the main part of the conveying apparatus in accordance with the embodiment of the present invention. FIG. 3 is a schematic sectional view of belt adsorbing means (or belt attracting means) in accordance with the embodiment of the present invention.

A conveying belt 31 provided with an adsorbing generating means 36 (having a configuration identical with that of the conventional art) by ctenidium electrodes is driven by a driving roller 34 and wound to be suspended by a conveying roller 32 and a pressure roller 35 that are driven rollers.

The conveying roller 32 and the driving roller 34 are rotatably attached to a conveying apparatus frame 30. The pressure roller 35 is rotatably attached to the other end of an arm 50 that is swingably attached to the conveying apparatus frame 30 at one end and applies a tension (19.6 N) to the conveying belt 31 by the arm 50 being pressed by a spring 51.

In a position opposing the conveying roller 32, a pinch roller 33 following the conveying belt 31 is provided so as to abut the conveying belt 31. The pinch roller 33 comes into press contact with the conveying belt 31 by a not-shown spring, thereby introducing a recording sheet P onto the conveying belt 31. In addition, the pinch roller 33 communicates with a main body frame (not shown), thereby removing charge accumulated in a surface layer 36*d* of the conveying belt 31.

At an entrance of the conveying belt 31 to which the recording sheet P is conveyed, an upper guide 27 and a lower guide 28 that guide the recording sheet P are arranged. In addition, a PE sensor lever 23 for transmitting detection of a front end and a rear end of the recording sheet P to a PE sensor (not shown) is provided in the upper guide 27.

Moreover, a recording head 7 for forming an image based on image information is provided on the downstream side in the conveying direction of a recording sheet of the conveying roller 32.

In the above-mentioned configuration, the recording sheet P conveyed to the conveying belt 31 is guided to the upper guide 27 and the lower guide 28 and then conveyed to a roller pair of the conveying roller 32 and the pinch roller 33. At this point, a recording position on the recording sheet P is found by sensing the front end of the conveyed recording sheet P by the PE sensor lever 23.

Then, the recording sheet P is conveyed by the conveying belt 31 rotating via the conveying roller 32 by a sheet feeding motor to be described later.

Belt attracting means that characterizes the present invention most will now be described.

Belt attracting means 37 is composed of a protruded part 37*a*, a sliding surface 37*b* and a low friction layer 37*c*. A plurality of belt attracting means 37 are provided perpendicular to a belt conveying direction on the conveying apparatus frame 30.

Each belt attracting means 37 is provided in a position opposing the corresponding recording head 7 with the conveying belt 31 between them. The sliding surface 37*b* and a nozzle surface (face) of the recording head 7 are disposed in parallel.

In order to obtain sufficient attractive force, the protruded part 37*a* is formed of a material having conductivity.

The sliding surface 37*b* is a surface that adsorbs the conveying belt 31 and slides, and is a plane having a predetermined width in the conveying direction. Further, sliding surfaces 37*b* of respective belt attracting means 37 are arranged to be positioned on an identical plane.

The low friction layer 37*c* is formed of a low friction material such as a Teflon film or a high molecule volume polyethylene film (thickness: 100 $\mu$m, friction coefficient: 0.2) and realizes a reduction in friction between the conveying belt 31 and the sliding surface 37*b* and stabilization of rotation loading during rotation to secure conveying accuracy.

The principle on which cockling of a conveying belt due to an influence of flopping of the conveying belt during conveyance and a remaining wrinkle shape being suppressed in the embodiment of the present invention will be described.

When the recording sheet P is conveyed, a high voltage (0.5 kV to 10 kV) is applied to the conveying belt 31 provided with ctenidium electrodes to generate an electric force, whereby the recording sheet P is adsorbed on the upper surface of the conveying belt 31 and the lower surface is attracted or adsorbed to the protruded part 37*a* of the belt attracting means 37. Thus, displacement in the vertical direction is suppressed and stable conveyance is realized.

Figure 4A:
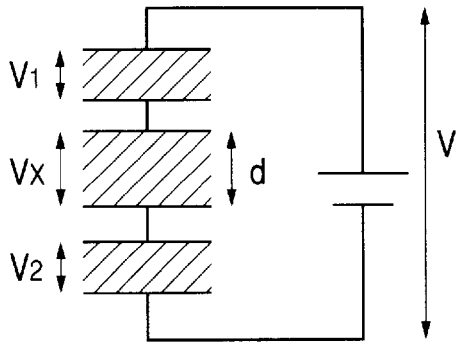
FIG. 4A illustrates modeled conveying belt and protruded parts.

When the conveying belt 31 and the protruded part 37*a* are modeled, they can be regarded as capacitors connected in series as shown in FIG. 4A. Thus, the following expression is established concerning the attractive force F between an electrode plate 36*a* and the protruded part 37*a*.

$$F=(\in S/2d^2)\times(V-V_1-V_2)^2 \quad (1)$$

Here, V is a high voltage to be applied to the conveying belt 31, $V_1$ is a partial pressure to be applied to a base layer 36*c*, $V_2$ is a partial pressure to be applied to the low friction layer 37*c*, e is a permittivity (or dielectric constant) of a space consisting of the base layer 36*c* and the low friction layer 37*c*, S is an area of the upper surface of the protruded part 37*a* and d is a distance between the electrode plate 36*a* and the protruded part 37*a*.

As can be seen from the above expression, the attractive force F is inversely proportional to a square of the distance between the electrode plate 36*a* and the protruded part 37*a*, that is, thickness of the base layer 36*c* and the low friction layer 37*c*, and proportional to the width (area) of the upper surface of the protruded part 37*a*, and increases and decreases in proportion to a square of a voltage (applied across the space) obtained by subtracting the partial pressures of the base layer 36*c* and the low friction layer 37*c* from the applied voltage.

Figure 4B:
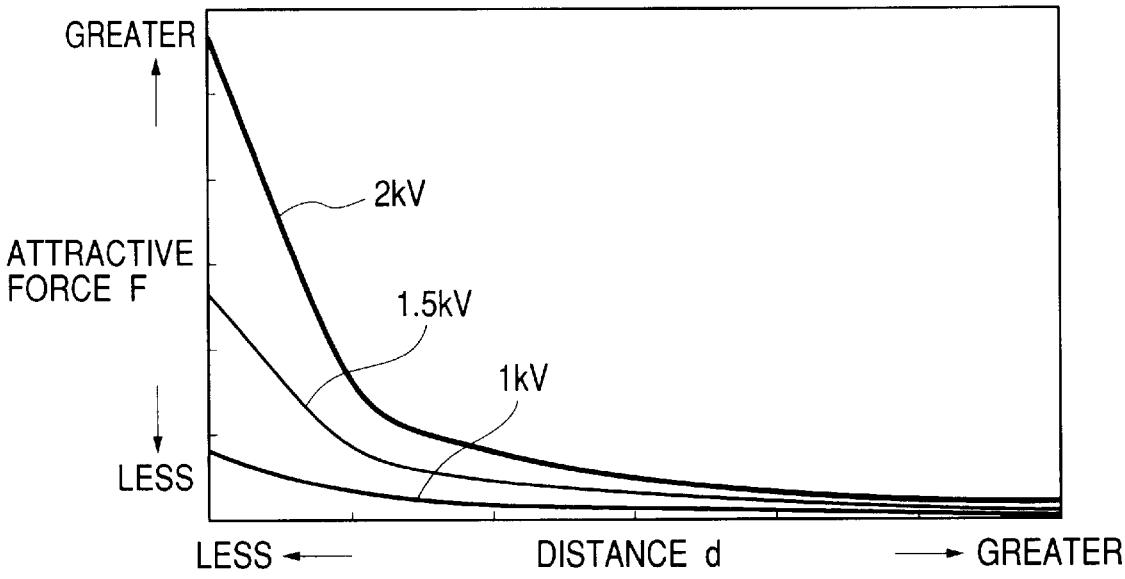
FIG. 4B is a graph showing increase and decrease of attractive force F when an applied voltage V and a distance d between an electrode plate and a protruded part are changed.

FIG. 4B is a graph showing the increase and decrease of the attractive force F when the applied voltage V and the distance d are changed in the case in which an area S of the upper surface of the protruded part 37*a* is kept constant. It is seen from the graph that the smaller the distance d the stronger the attractive force.

When a repulsion (combined force of a restoring force of the remaining wrinkle shape, flopping during conveyance or the like) in the upward direction (direction opposite to the direction of the belt attracting means 37) acting on the conveying belt 31 in the conveying state is smaller than the attractive force F, the conveying belt 31 is always drawn to the belt attracting means 37.

In addition, an attractive force can be made stronger by increasing a partial pressure acting on a space formed of the base layer 36*c* and the low friction layer 37*c*. That is, it is sufficient to increase an electric capacity of the base layer 36*c* and the low friction layer 37*c* to decrease a partial pressure applied to these.

In this way, it becomes possible to increase an attractive force by reducing the thickness of the base layer 36*c* and the low friction layer 37*c* and using a material with a high permittivity.

In this embodiment, the sliding surface 37*b* of the belt attracting means 37 provided opposing each of the plurality of recording heads 7 and the plane connecting the upper surfaces of the conveying roller 32 and the driving roller 34 are configured to be in the same plane.

In addition, a width in the conveying direction of the protruded part 37*a* of the belt attracting means 37 is set at 15 mm (a width in the direction perpendicular to the conveying direction is identical with a nozzle width), and the base layer 36*c* is formed of polyimide with a thickness of 120 $\mu$m and the low friction layer 37*c* is formed of Teflon with a thickness of 100 $\mu$m.

In the above-mentioned configuration, the applied voltage is set at 1.5 kV, whereby an attractive force sufficient for suppressing cockling due to the influence of flopping during conveyance and the remaining wrinkle shape can be obtained in the conveying belt 31 in accordance with this embodiment.

However, if an attractive force is too strong, the conveying belt 31 is stuck to the belt attracting means 37, which may increase rotation loading to stop rotation. Thus, it is required to optimize an attractive force acting vertically and a kinetic friction force of the base layer 36*c* and the low friction layer 37*c*.

Concerning the base layer 36*c*, if its friction is made too low, friction between the base layer 36*c* and the driving roller 34 is reduced and slipping occurs, which makes accurate conveyance impossible. Thus, a friction force of a certain degree is required. Concerning the low friction layer 37*c*, it is desirable to use a material that has a high permittivity and a small friction coefficient and is excellent in abrasion resistance.

Figure 5A:
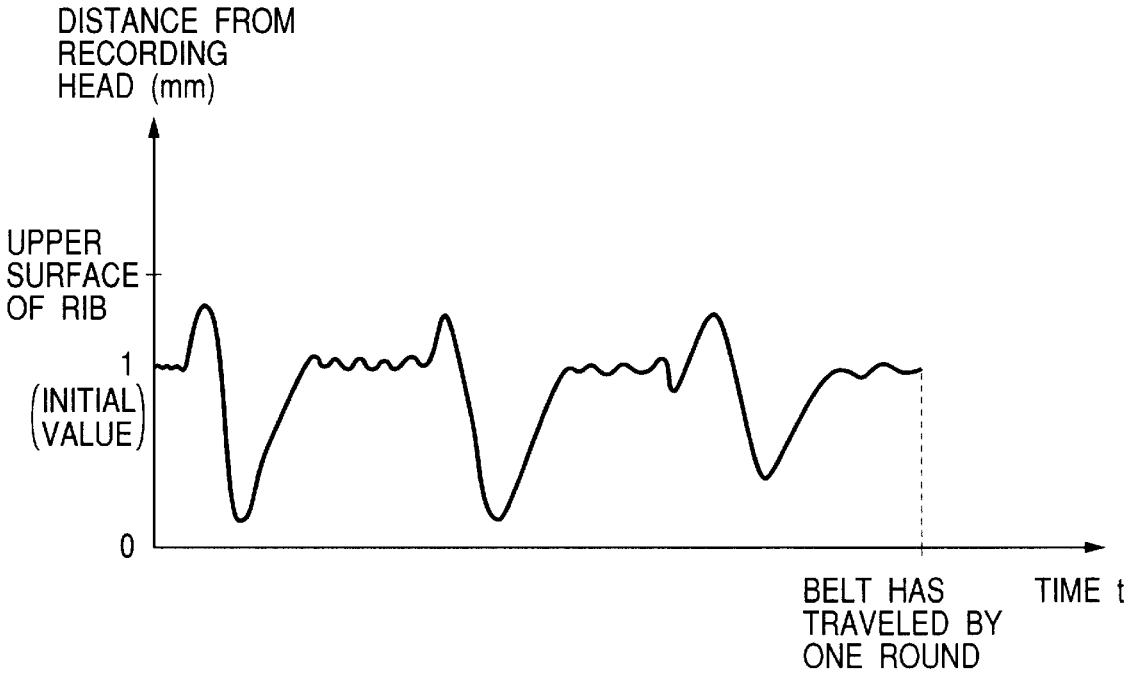
FIG. 5A is a graph showing a result of measurement of variations of an interval between a recording head and a conveying belt when a conveying belt having a remaining wrinkle shape is driven to convey at a high speed in a conveying apparatus in accordance with a conventional art.
Figure 5B:
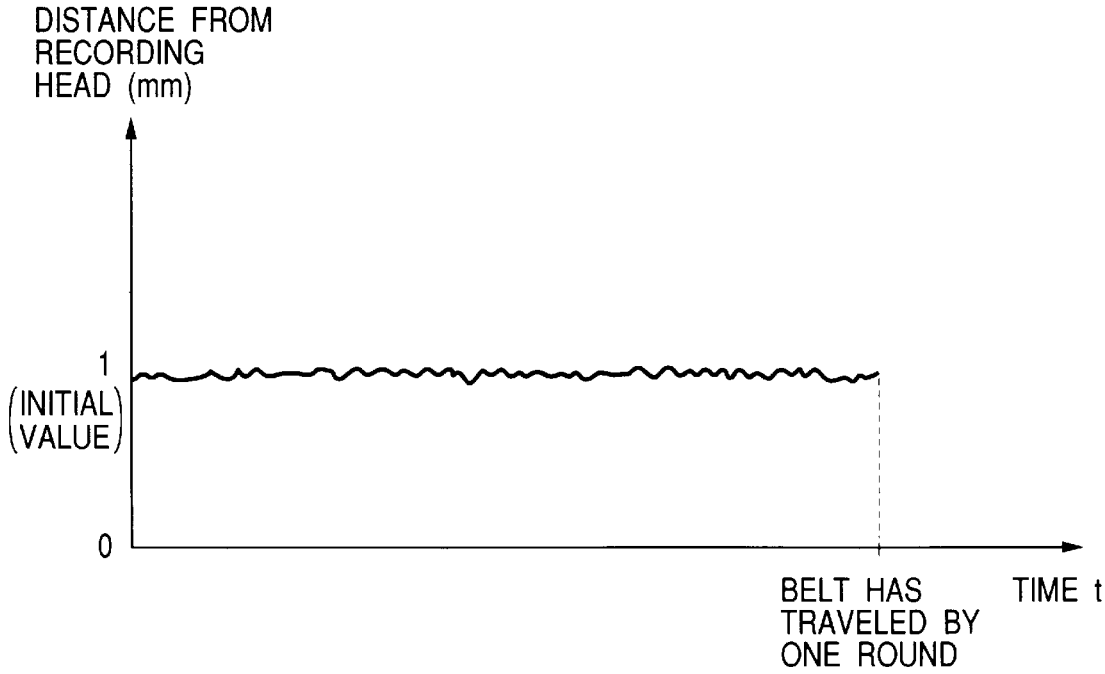
FIG. 5B is a graph showing a result of measurement of variations of an interval between a recording head and a conveying belt when a conveying belt having a remaining wrinkle shape is driven to convey at a high speed in the conveying apparatus in accordance with the embodiment of the present invention.

FIG. 5 is a graph showing measurement of variations of an interval between a recording head and a conveying belt having a remaining wrinkle shape when the conveying belt is driven to convey at a high speed. FIG. 5A shows measurement results in a conveying apparatus in accordance with a conventional art. FIG. 5B shows measurement results of a conveying apparatus in accordance with this embodiment.

In the conveying apparatus in accordance with the conventional art shown in FIG. 5A, it can be seen that influence of remaining wrinkle shapes due to a conveying roller, a driving roller and a pressure roller occurs, respectively, and the conveying belt is displaced to the vicinity of an upper surface of a rib immediately after the conveying belt is affected by the remaining wrinkle shapes. This is cockling of a conveying belt due to influence of a remaining wrinkle shape. In addition, a small undulation during the large displacement is flopping during conveyance.

The displacement of cockling and flopping during conveyance is 1 mm or more, and it is difficult to convey a recording sheet keeping a fixed distance with a recording head. In addition, it is impossible to reduce the distance between a recording head and a conveying belt if influence of cockling due to a recording operation is taken into consideration.

On the other hand, in the conveying apparatus in accordance with this embodiment shown in FIG. 5B, the conveying belt 31 slides with being adsorbed to the belt attracting means 37. Thus, it is possible to suppress displacement of the recording head 7 and the conveying belt 31 to 0.1 mm or less.

In this way, according to the conveying apparatus in accordance with this embodiment, it becomes possible to record an image on a recording sheet while keeping a distance between a recording head and a recording sheet constant without being affected by the influence of a remaining wrinkle shape of a conveying belt and the influence of flopping during conveyance from the start of operations.

Further, the conveying belt 31 provided with ctenidium electrodes has electrode plates 36*a* inside the belt. Therefore, even if a recording sheet is adsorbed on the recording head 7 side (upper surface) and the conveying belt 31 is adsorbed by the belt attracting means 37 on the other side (lower side), the mutual adsorption force is not substantially affected.

<Second Embodiment>

A second embodiment will be described with reference to FIGS. 6 to 8. In the second embodiment, a positional relation between a belt attracting means and electrodes, that is, a positional relation between a recording head and electrodes, is provided.

Figure 6:
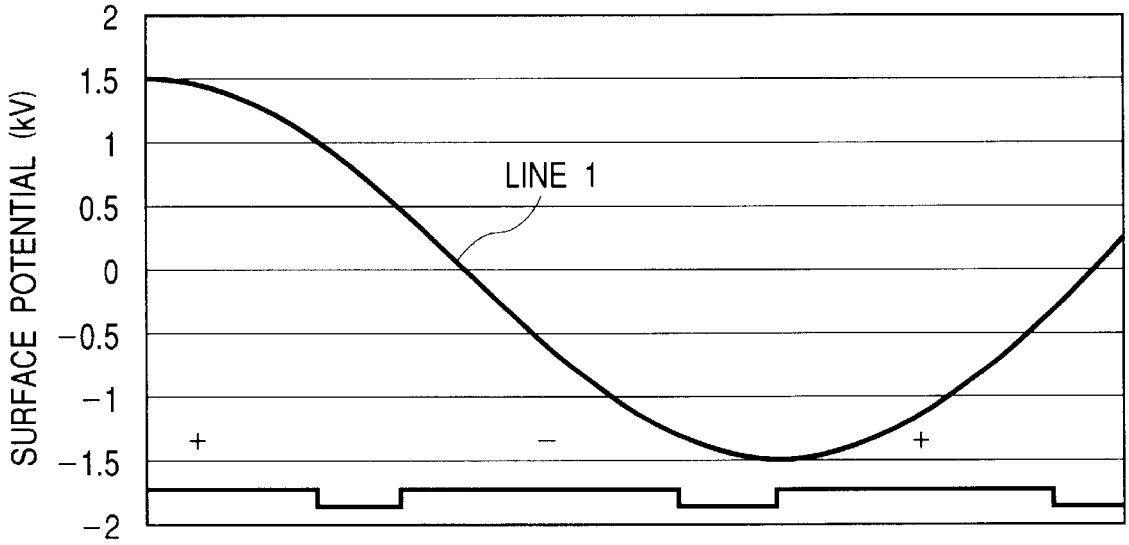
FIG. 6 is a graph showing measurements of surface potentials of a conveying belt with ctenidium electrodes of a second embodiment.

FIG. 6 shows a distribution curve in conveying direction of a surface potential on a surface layer that is generated when positive and negative high voltages are applied to left and right electrode units, respectively. A maximum potential is generated around an electrode to which a positive voltage is applied and a minimum potential is generated around an electrode to which a negative voltage is applied. A measurement result substantially shows a distribution of a sine wave-form. A similar distribution is also measured on a base layer side, and as a result, an attracting force described in the first embodiment is generated, which makes it possible to steadily move a conveying belt.

When a surface potential E of a head position (corresponding to a protruded part position) in a line 1 in the most upstream in the conveying direction is formulated, the following expression is established.

$$E=E_{over}\times\cos(PS\times\pi/(H_{point}+H_{space})\times t) \quad (2)$$

In the above expression (2), PS is a belt conveying speed, $E_{over}$ is a maximum surface potential, $H_{point}$ is an electrode width and $H_{space}$ is a distance between electrodes.

However, as can be seen from the above expression (1) and FIG. 6, since an adsorption force changes according to a potential difference, if ctenidium shapes of electrode plates and ground plates provided on a conveying belt are arranged regularly, distributions of potentials in protruded parts of platens arranged at an arbitrary interval are different. A surface potential E in a second line positioned at a distance $L_2$ can be formulated by the following expressions.

$$E=E_{over}\times\cos(PS\times\pi/(H_{point}+H_{space})\times(t-L_2/PS))$$

$$E=E_{over}\times\cos(PS\times\pi/(H_{point}+H_{space})\times t-\pi\times L_2/(H_{point}+H_{space}) \quad (3)$$

Thus, it can be seen that, it becomes possible to reduce variations of work load due to an adsorption force by a potential difference by minimizing the sum of variation amounts of absolute values of potentials in each head position. In this embodiment, taking a conveyance accuracy into consideration, a plurality of recording heads (here, the case of five color recording heads is exemplified) are arranged at an equal interval that is an interval of a driving roller circumference length, and protruded parts 30*a* of the platens 30 opposing these respective recording heads are also arranged at an equal interval that is an interval of a driving roller circumference length. In this case, taking a relation between positiveness or negativeness of a surface potential and an attraction into consideration, it becomes possible to minimize (fine) a variation of work load, which is generated between the conveying belt 31 and the platen 30 when the conveying belt operates, by making an electrode pattern ($H_{point}+H_{space}$) with which the following expression is established. In the following expression, L is an interval in a conveying direction of a head, N is an integer and $n_h$ is the number of heads.

$$\pi\times L/(H_{point}+H_{space})=\pi\times(N+1/n_h) \quad (4)$$

Figure 7:
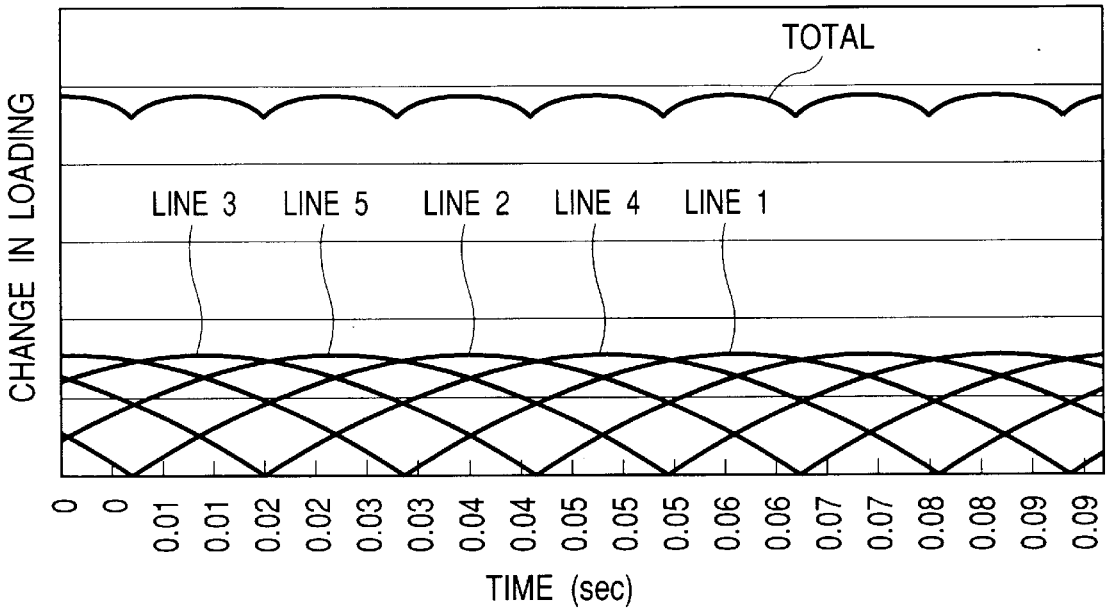
FIG. 7 is a graph showing variations of work load in the case in which an appropriate arrangement of the second embodiment is performed.
Figure 8:
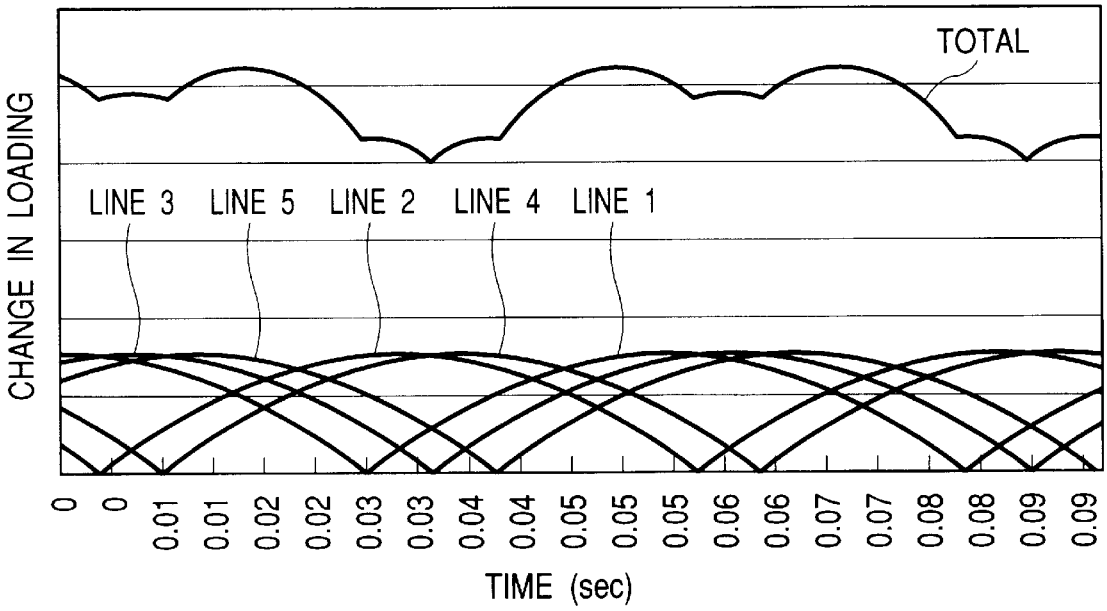
FIG. 8 is a graph showing variations of work load in the case in which the appropriate arrangement of the second embodiment is not performed.
Figure 9:
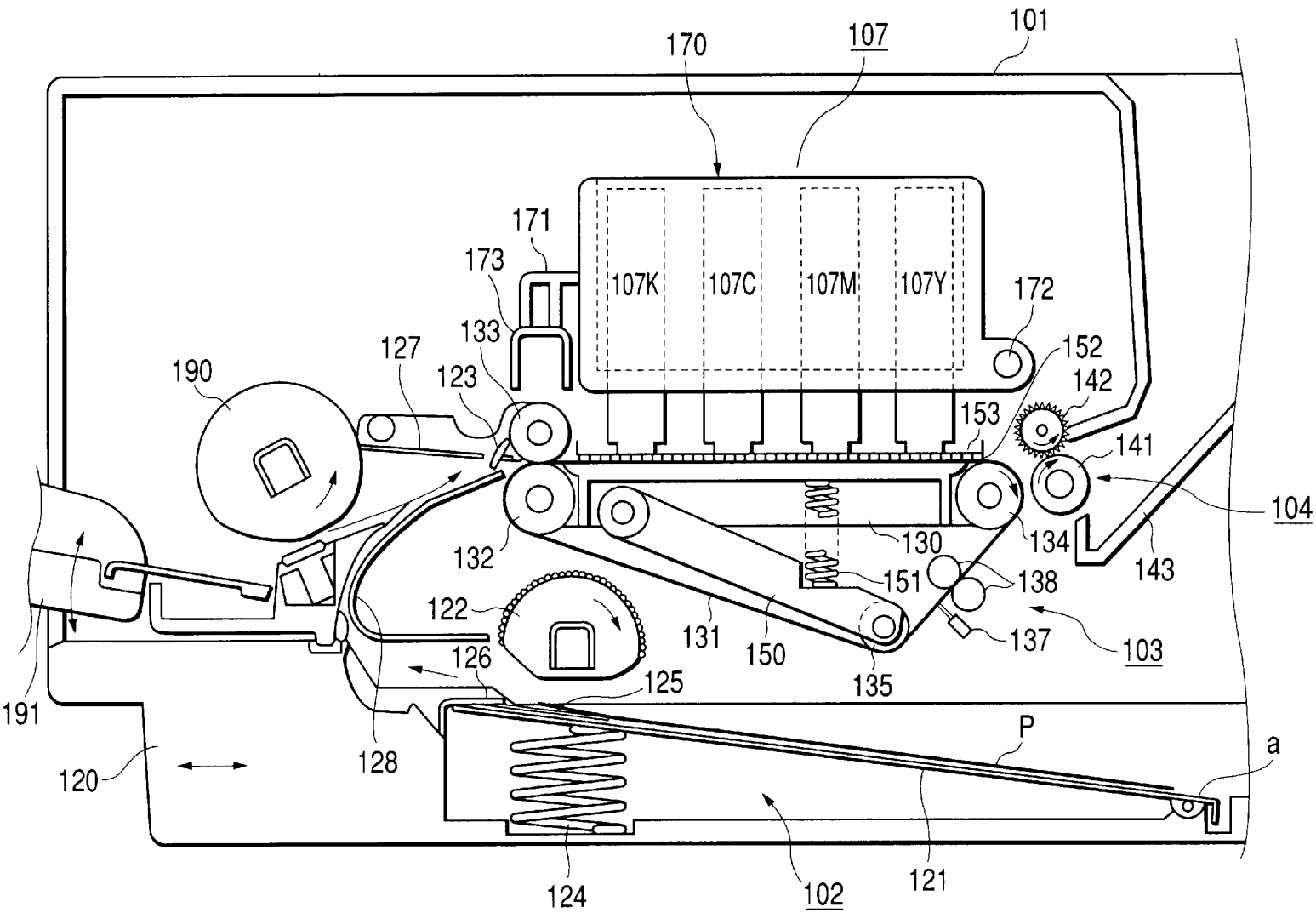
FIG. 9 is a schematic view showing a configuration of an entire recording apparatus in accordance with the conventional art.
Figure 10:
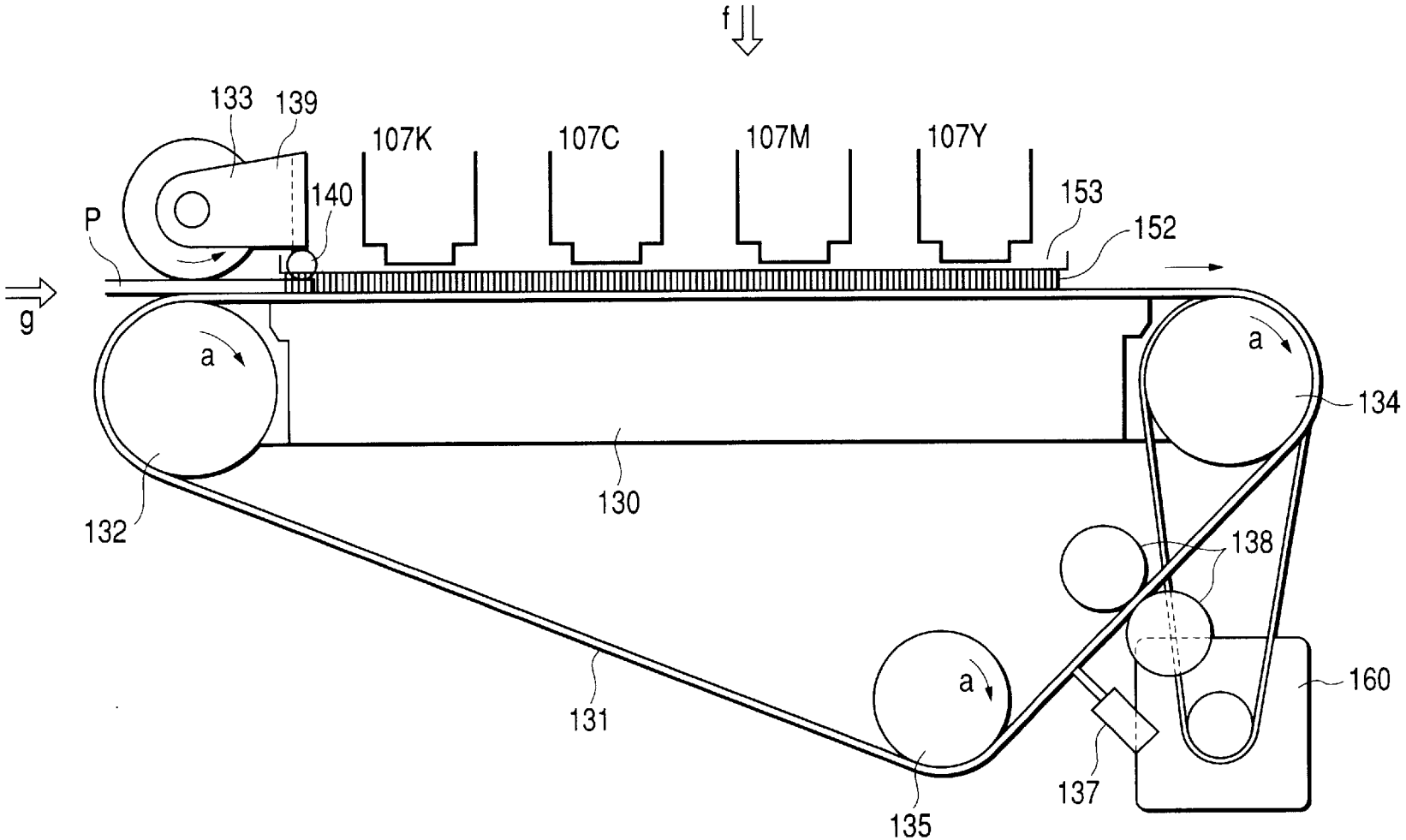
FIG. 10 is a schematic view showing a configuration of a conveying apparatus in accordance with the conventional art.
Figure 11:
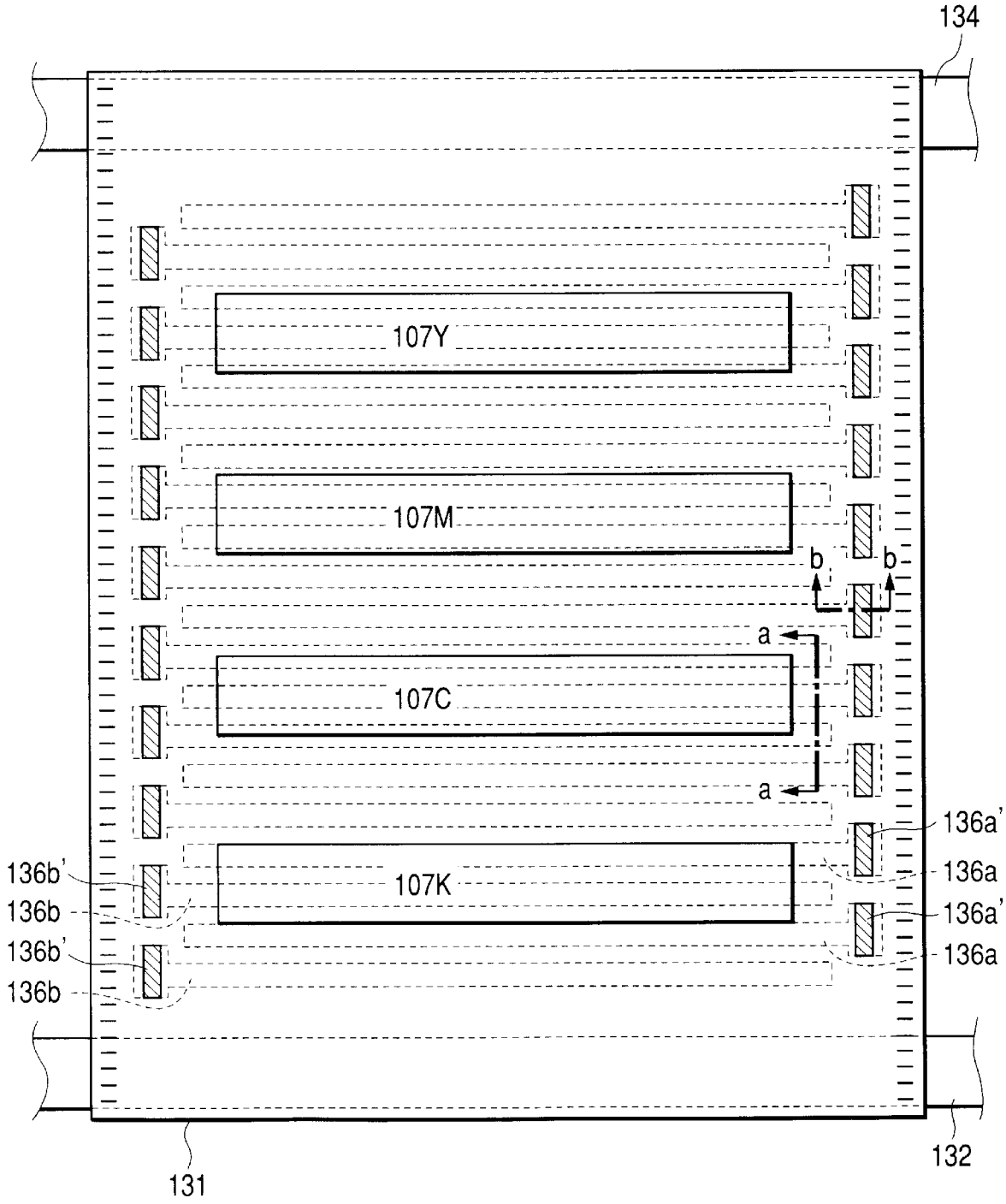
FIG. 11 is a schematic view showing a configuration of a conveying belt viewed from an arrow f direction of FIG. 10.
Figure 12:
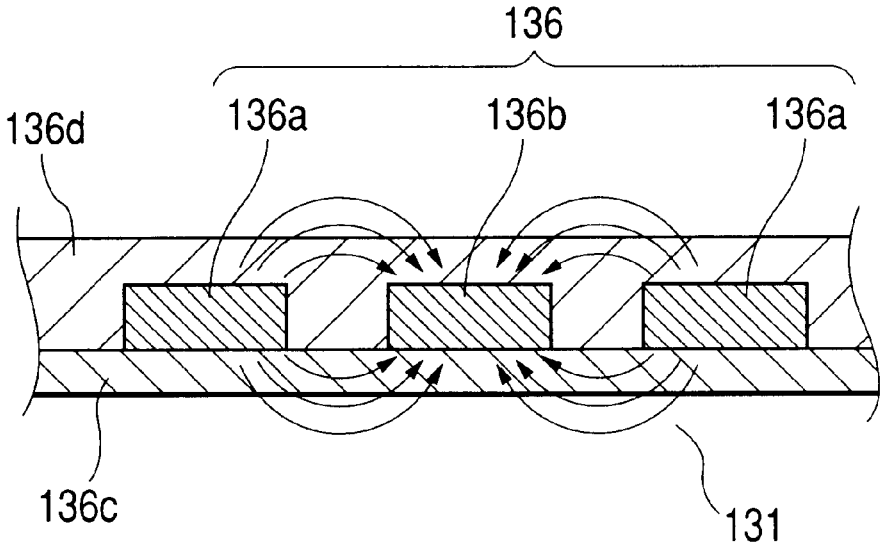
FIG. 12 is a sectional view of the conveying belt viewed from an arrow a direction of FIG. 11.
Figure 13:
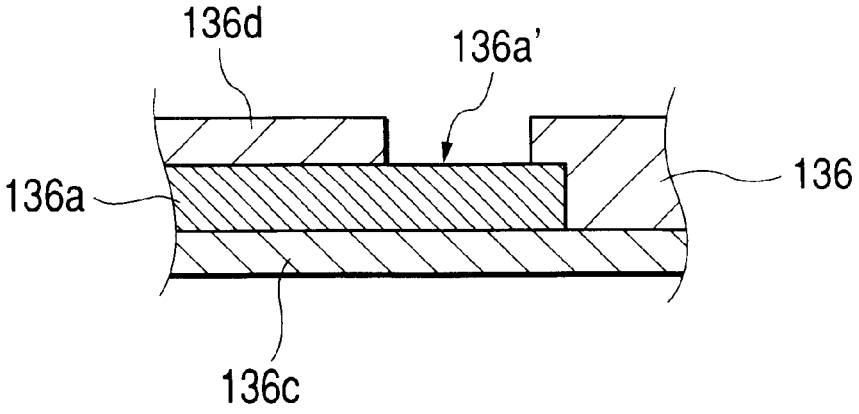
FIG. 13 is a sectional view of the conveying belt viewed from an arrow b direction of FIG. 11.
Figure 14:
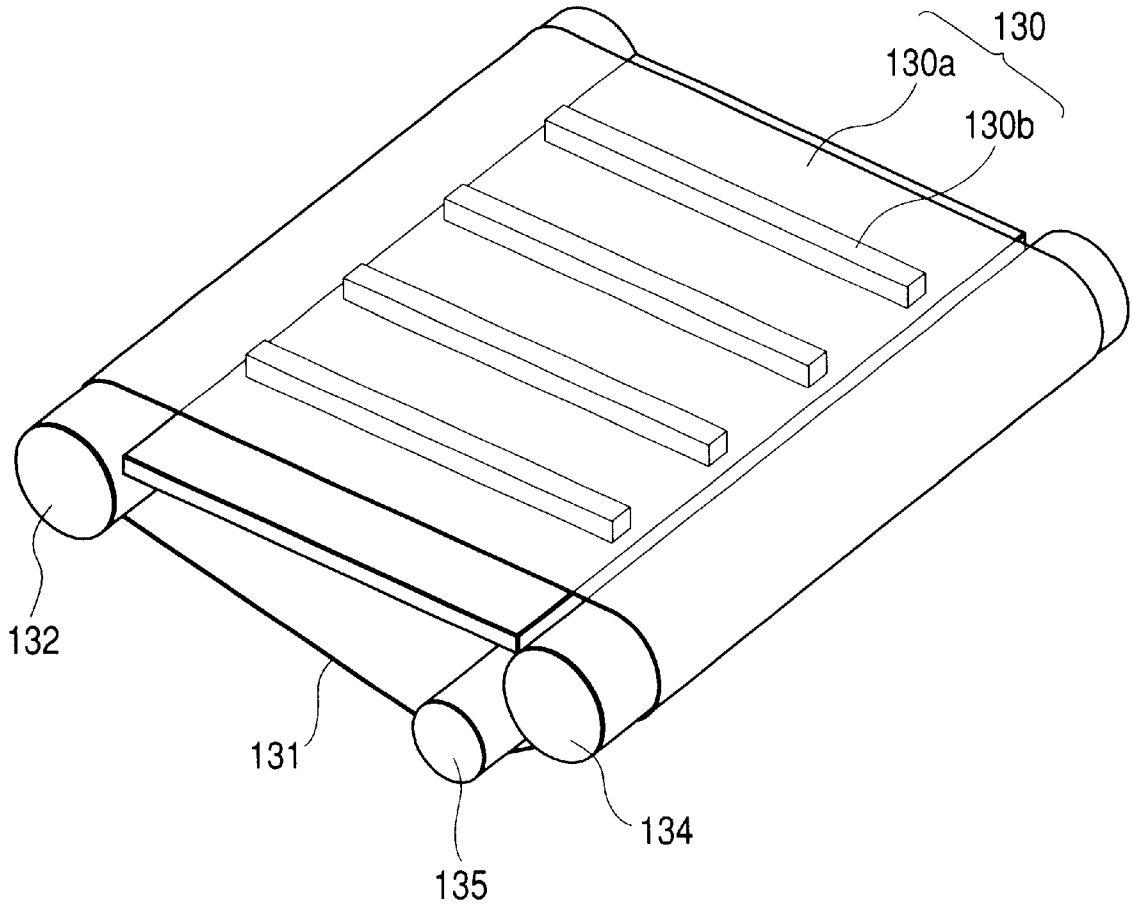
FIG. 14 is a schematic perspective view showing a configuration of a platen in accordance with the conventional art.
Figure 15:
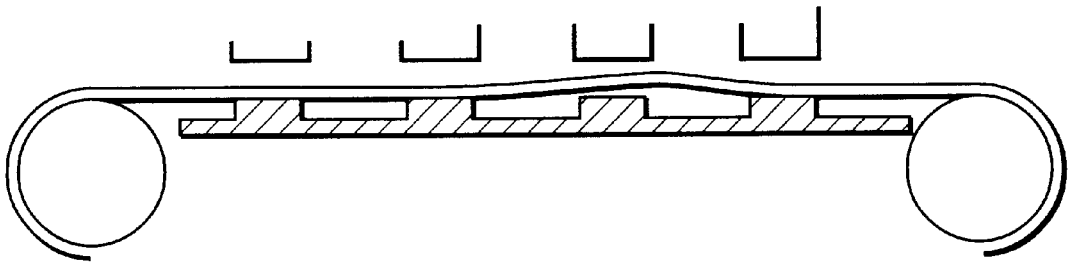
FIG. 15 is a view illustrating a remaining wrinkle shape of a conveying belt.
Figure 16:
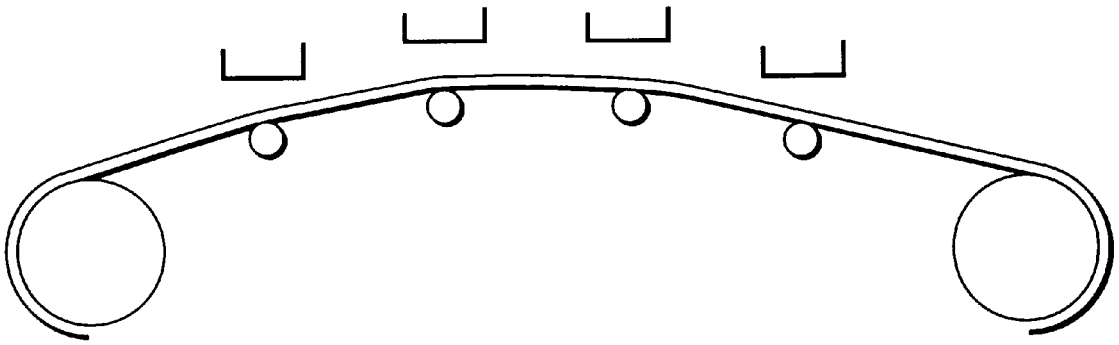
FIG. 16 is a view illustrating a method of providing a spur to spread and suspend a conveying belt.

A curve of change in loading due to electrostatic force in the case in which a pattern of ctenidium electrodes is changed is shown in FIGS. 7 and 8. FIG. 7 is a graph of the case in which recording positions (positions of protruded parts of platens opposing each recording head) are arranged in positions satisfying the above expression (4), to which a pattern of ctenidium electrodes is set. It can be seen from the graph that the change in work load generated between the conveying belt 31 and the protruded part 30*a* of the platen 30 is minute when the conveying belt is operated in this case. On the other hand, FIG. 8 is a graph of the case in which recording positions are identical with those in FIG. 7 but a pattern of ctenidium electrodes takes a value that does not satisfy the above expression (4). It can be seen from the graph that the change in loading is irregular and differs greatly.

In this way, recording positions (positions of protruded parts of platens opposing each recording head) and a pattern of ctenidium electrodes are optimized, whereby it becomes possible to minimize the change in work load, which occurs between a conveying belt and protruded parts of platens when the conveying belt is operated, to realize stable conveying accuracy.

<Third Embodiment>

In the above-mentioned embodiment, a plurality of belt attracting means 37 are provided perpendicular to a belt conveying direction, each of which is disposed in a position opposing a corresponding recording head 7 with the conveying belt 31 between them. However, the configuration of a conveying apparatus is not limited to the above as long as it can generate an adsorption force sufficient for suppressing vibration of a belt during conveyance.

For example, the belt attracting means 37 may be disposed in parallel with the belt conveying direction. Alternatively, the width of the conveying belt 31 is set sufficiently wide compared with the width of the recording sheet P or the recording head 7 to provide the belt attracting means 37 thereon such that it attracts a side end of the conveying belt 31, whereby the belt attracting means 37 can be provided on the same side as the recording sheet P or the recording head 7.

In addition, in the above-mentioned embodiment, the protruded part 37*a* of the belt attracting means 37 is formed of conductive metal. However, it may be formed of a conductive material that is resin coated with conductive paint instead of conductive metal.

In addition, although the low friction layer 37*c* is formed of a film such as Teflon, a low friction material may be coated instead of a film. It is anticipated that adjustment in a thickness direction is necessary in the case of coating.

<Other Embodiments>

In the above-mentioned embodiments, an ink-jet recording apparatus for color recording using a plurality of recording heads for recording an image with inks of different colors is exemplified and described. However, the present invention is not limited to this and can be similarly applied to, for example, an ink-jet recording apparatus using one recording head or an ink-jet recording apparatus for gradation recording using a plurality of recording heads for recording inks of identical color and different densities, regardless of the number of recording heads, and can attain similar operational effects.

Moreover, as to recording means (a recording head), the present invention can be similarly applied to any recording means and ink tanks whatever their configurations are, such as recording means of a cartridge type in which a recording head and an ink tank are integrated or recording means with a configuration in which a recording head and an ink tank are separate and these are connected with an ink supplying tube, and can attain similar effects.

Further, if the present invention is applied to an ink-jet recording apparatus the present invention can be applied to an ink-jet recording apparatus using recording means employing an electromechanical converter or the like such as a piezo-element. In particular, the present invention provides an excellent effect in an ink-jet recording apparatus using recording means of a method for discharging ink utilizing thermal energy. This is because high density and high definition of recording can be attained by such a method.

Moreover, the present invention can also be effectively applied to a recording apparatus of a so-called serial type which records an image while moving a recording head in a direction perpendicular to the conveying direction of a recording medium. Alternatively, even in a recording apparatus of full-line type in which a recording head has a length corresponding to a maximum recordable width of a recording medium, such a recording head may have either a configuration meeting the length or a configuration as one integrally formed recording head according to a combination of a plurality of recording heads. In addition, even if the recording head is the above-mentioned serial type, the present invention is effective in the case where there is used a recording head fixed to an apparatus main body, a recording head of a replaceable chip type which is inserted in the apparatus main body, to enable electric connection to the apparatus main body or supply of ink from the apparatus main body, or a recording head of a cartridge type integrally provided with an ink tank.

Moreover, a form of the above-mentioned ink-jet recording apparatus may be an ink-jet input/output apparatus in which a scanner or the like other than a recording head can be mounted on a carriage, a copying apparatus combined with a reader or the like, a facsimile apparatus having transmission/reception functions or the like in addition to an ink-jet recording apparatus used as an image output terminal apparatus of information processing equipment such as a computer.

In addition, an ink-jet recording method is exemplified as a recording method in the above-mentioned embodiments. However, a recording method is not necessarily limited to this, and the present invention can be applied to a recording method such as a heat transfer recording method or a thermal sensitive recording method, an impact recording method such as a wire dot recording method, or other electrophotographic methods.

As described above, according to this embodiment, conveying belt attracting means for attracting a conveying belt by an electric force is provided. Thus, cockling of the conveying belt due to influence of flopping of the conveying belt during conveyance or a remaining wrinkle shape can be suppressed, and a sheet can be steadily conveyed.

In addition, if belt attracting means is formed of a material having conductivity, stronger attractive force can be generated.

In addition, a conveying belt and belt attracting means are provided such that they are adsorbed to each other and slide, whereby vibration of the conveying belt can be further suppressed.

In this case, if a sliding portion made of a low friction material is provided in a position sliding against the conveying belt of the belt attracting means, since loading applied to the conveying belt when it slides becomes less, conveyance is effective.

Moreover, if the sliding portion is formed of a conductor, stronger attracting force can be generated.

In a recording apparatus provided with recording means for recording an image on a sheet conveyed by the above-mentioned conveying apparatus, the sheet can be steadily conveyed by the belt attracting means. Thus, a distance between the recording means and the conveying belt can be kept constant, and high-speed and high definition recording of an image becomes possible.

As many apparently widely different embodiments of the present invention can be made without departing from the spirit and scope thereof, it is to be understood that the invention is not limited to the specific embodiments thereof except as defined in the appended claims.

What is claimed is:

1. A conveying apparatus for attracting a conveyed object by a belt provided with electrodes to convey the object, comprising:

applying means for applying a voltage to said electrodes to generate an electric force; and belt attracting means, provided on a side of said belt opposite to a belt surface that attracts the conveyed object, for attracting said belt utilizing the electric force, wherein said belt attracting means has a sliding portion which is comprised of a low friction material, and said belt slides on said sliding portion, and wherein said belt moves while being attracted to said belt attracting means.

2. A conveying apparatus according to claim 1, wherein said electrodes are provided in a ctenidium shape perpendicular to a conveying direction of said belt and a positive or negative voltage is applied to said electrodes by said applying means.

3. A conveying apparatus according to claim 1, wherein said belt attracting means has conductivity.

4. A conveying apparatus according to claim 1, wherein said sliding portion is made of dielectric material.

5. A recording apparatus for attracting a conveyed object by a belt provided with electrodes to convey the object and recording an image on the conveyed object by recording means, comprising:

applying means for applying a voltage to said electrodes to generate an electric force; and belt attracting means, provided on a side of said belt opposite to a belt surface that attracts the conveyed object, for attracting said belt utilizing the electric force, wherein said belt attracting means has a sliding portion which is comprised of a low friction material, and said belt slides on said sliding portion, wherein said belt attracting means is provided at a position opposing said recording means, and wherein said belt moves while being attracted to said belt attracting means.

6. A recording apparatus according to claim 5, wherein said electrodes are provided in a ctenidium shape perpendicular to a conveying direction of said belt and a positive or negative voltage is applied to said electrodes by said applying means.

7. A recording apparatus according to claim 5, wherein said belt attracting means has conductivity.

8. A recording apparatus according to claim 5, wherein said sliding portion is made of dielectric material.

9. A recording apparatus according to claim 5, wherein said recording means is a recording head for discharging ink to record an image on a recording sheet.

10. A recording apparatus according to claim 9, wherein said recording head energizes an electrothermal transducer according to a signal and discharges ink utilizing thermal energy emitted by the electrothermal transducer.

11. A recording apparatus for attracting a conveyed object by a belt provided with electrodes to convey the object and recording an image on the conveyed object by a plurality of recording means arranged along a conveying direction of said belt, comprising:

applying means for applying a voltage to said electrodes to generate an electric force; and belt attracting means for attracting said belt utilizing the electric force, said belt attracting means being provided in a position opposing said recording means, wherein the recording apparatus satisfies an expression of $$\pi \times L/(H_{point}+H_{space})=\pi \times (N+1/n_h)$$

when an interval of the recording means in the conveying direction of said belt is L, a width of said electrodes is $H_{point}$, a distance between said electrodes is $H_{space}$, the number of said recording means is $n_h$ and N is an integer.

12. A recording apparatus according to claim 11, wherein said electrodes are provided in a ctenidium shape perpendicular to the conveying direction of said belt and a positive or negative voltage is applied to said electrodes by said applying means.

13. A recording apparatus according to claim 11, wherein said belt attracting means is provided on a side of said belt opposite to a belt surface that attracts the conveyed object.

14. A recording apparatus according to claim 11, wherein said belt attracting means has conductivity.

15. A recording apparatus according to claim 11, wherein said belt moves while being attracted to said belt attracting means.

16. A recording apparatus according to claim 15, wherein a sliding portion comprised of a low friction material is provided at a position where said belt attracting means slides against said belt.

17. A recording apparatus according to claim 16, wherein said sliding portion is made of dielectric material.

18. A recording apparatus according to claim 11, wherein said recording means is a recording head for discharging ink to record an image on the conveyed object.

19. A recording apparatus according to claim 18, wherein said recording head energizes an electrothermal transducer according to a signal and discharges ink utilizing thermal energy emitted by the electrothermal transducer.

* * * * *

UNITED STATES PATENT AND TRADEMARK OFFICE

CERTIFICATE OF CORRECTION

PATENT NO. : 6,695,504 B2
DATED : February 24, 2004
INVENTOR(S) : Tadashi Matsumoto It is certified that error appears in the above-identified patent and that said Letters Patent is hereby corrected as shown below:

Column 5,
Line 8, "an" should read -- and --.

Column 7,
Line 19, "FIG. 4Aillustrates" should read -- FIG. 4A illustrates --.

Column 9,
Line 44, "e" should read -- ε --.

Column 14, line 34 through Column 16, line 35,
Claims 1-19 should be deleted and substituted with the following claims 1-19:

--1. A conveying apparatus for attracting a conveyed object by a belt, comprising:

electrodes provided inside said belt for attracting the conveyed object to a surface of said belt;

applying means for applying a voltage to said electrodes to generate an attracting force; and belt attracting means, provided on a side of said belt opposite to the belt surface that attracts the conveyed object, utilizing an electric force, wherein said belt attracting means has a sliding portion which is comprised of a low friction material, and said belt slides on said sliding portion, and wherein said belt moves while being attracted to said belt attracting means, the conveyed object being attracted to the surface of said belt.

2. A conveying apparatus according to claim 1, wherein said electrodes are provided in a ctenidium shape perpendicular to a conveying direction of said belt and a positive or negative voltage is applied to said electrodes by said applying means.

3. A conveying apparatus according to claim 1, wherein said belt attracting means has conductivity.

4. A conveying apparatus according to claim 1, wherein said sliding portion is made of dielectric material.

5. A recording apparatus for conveying a conveyed object by a belt, and recording an image on the conveyed object by recording means, comprising:

It is certified that error appears in the above-identified patent and that said Letters Patent is hereby corrected as shown below:

Column 14, line 34 through Column 16, line 35 (cont'd), electrodes provided inside said belt for attracting the conveyed object to a surface of said belt;

applying means for applying a voltage to said electrodes to generate an attracting force; and belt attracting means, provided on a side of said belt opposite to the belt surface that attracts the conveyed object, utilizing an electric force, wherein said belt attracting means has a sliding portion which is comprised of a low friction material, and said belt slides on said sliding portion, and wherein said belt moves while being attracted to said belt attracting means, the conveyed object being attracted to the surface of said belt.

6. A recording apparatus according to claim 5, wherein said electrodes are provided in a ctenidium shape perpendicular to a conveying direction of said belt and a positive or negative voltage is applied to said electrodes by said applying means.

7. A recording apparatus according to claim 5, wherein said belt attracting means has conductivity.

8. A recording apparatus according to claim 5, wherein said sliding portion is made of dielectric material.

9. A recording apparatus according to claim 5, wherein said recording means is a recording head for discharging ink to record an image on a recording sheet.

10. A recording apparatus according to claim 9, wherein said recording head energizes an electrothermal transducer according to a signal and discharges ink utilizing thermal energy emitted by the electrothermal transducer.

11. A recording apparatus for attracting a conveyed object by a belt provided with electrodes to convey the object and recording an image on the conveyed object by a plurality of recording means arranged along a conveying direction of said belt, comprising:

applying means for applying a voltage to said electrodes to generate an electric force; and belt attracting means for attracting said belt utilizing the electric force, said belt attracting means being provided in a position opposing said recording means, It is certified that error appears in the above-identified patent and that said Letters Patent is hereby corrected as shown below:

Column 14, line 34 through Column 16, line 35 (cont'd), wherein the recording apparatus satisfies an expression of $$\pi \times L / (H_{point} + H_{space}) = \pi \times (N + 1 / n_h)$$

when an interval of the recording means in the conveying direction of said belt is L, a width of said electrodes is $H_{point}$, a distance between said electrodes is $H_{space}$, the number of said recording means is $n_h$ and N is an integer.

12. A recording apparatus according to claim 11, wherein said electrodes are provided in a ctenidium shape perpendicular to the conveying direction of said belt and a positive or negative voltage is applied to said electrodes by said applying means.

13. A recording apparatus according to claim 11, wherein said belt attracting means is provided on a side of said belt opposite to a belt surface that attracts the conveyed object.

14. A recording apparatus according to claim 11, wherein said belt attracting means has conductivity.

15. A recording apparatus according to claim 11, wherein said belt moves while being attracted to said belt attracting means.

16. A recording apparatus according to claim 15, wherein a sliding portion comprised of a low friction material is provided at a position where said belt attracting means slides against said belt.

17. A recording apparatus according to claim 16, wherein said sliding portion is made of dielectric material.

18. A recording apparatus according to claim 11, wherein said recording means is a recording head for discharging ink to record an image on the conveyed object.

UNITED STATES PATENT AND TRADEMARK OFFICE

CERTIFICATE OF CORRECTION

PATENT NO. : 6,695,504 B2
DATED : February 24, 2004
INVENTOR(S) : Tadashi Matsumoto It is certified that error appears in the above-identified patent and that said Letters Patent is hereby corrected as shown below:

Column 14, line 34 through Column 16, line 35 (cont'd),

19. A recording apparatus according to claim 18, wherein said recording head energizes an electrothermal transducer according to a signal and discharges ink utilizing thermal energy emitted by the electrothermal transducer.--

Signed and Sealed this

Thirteenth Day of September, 2005

JON W. DUDAS
*Director of the United States Patent and Trademark Office*